US006460978B2

(12) United States Patent
Ogawa

(10) Patent No.: US 6,460,978 B2
(45) Date of Patent: Oct. 8, 2002

(54) LIQUID DISCHARGE HEAD HAVING NARROWED PORTION OF LIQUID FLOW PATH BETWEEN LIQUID CHAMBER AND MOVABLE MEMBER, METHOD OF MANUFACTURE THEREFOR, AND LIQUID DISCHARGE APPARATUS HAVING SUCH HEAD

(75) Inventor: Masahiko Ogawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,259

(22) Filed: Jul. 6, 2001

(65) Prior Publication Data

US 2002/0008739 A1 Jan. 24, 2002

(30) Foreign Application Priority Data

Jul. 12, 2000 (JP) ..... 2000-211404

(51) Int. Cl.[7] ..... B41J 2/05; B41J 2/17
(52) U.S. Cl. ..... 347/65; 347/94
(58) Field of Search ..... 347/63, 65, 56, 347/67, 92, 93, 94, 20, 54

(56) References Cited

U.S. PATENT DOCUMENTS 4,514,742 A 4/1985 Suga et al. ..... 347/85
4,897,674 A * 1/1990 Hirasawa ..... 347/94

FOREIGN PATENT DOCUMENTS

DE 0 436 047 A1 7/1991 ..... B41J/2/055
EP 436047 * 7/1991 ..... 347/65

* cited by examiner

*Primary Examiner*—Craig Hallacher
*Assistant Examiner*—Juanita Stephens
(74) *Attorney, Agent, or Firm*—Fitzpatrick, Cella, Harper & Scinto

(57) ABSTRACT

A liquid discharge head includes a discharge port for discharging liquid, a liquid flow path communicating therewith and provided with a heat generating member for generating bubbles by heating the liquid, and a common liquid chamber for retaining the liquid to be supplied to the liquid flow path. A narrowed portion is provided in the liquid flow path between the common liquid chamber and the heat generating member. Between the narrowed portion and the heat generating member, a displaceable plate type movable member is provided. The movable member stands up from the surface of the liquid flow path having the heat generating member, in a direction substantially perpendicular to the liquid supplying direction. A first gap is provided between the narrowed portion and the movable member, and a second gap is provided between a free end of the movable member and a ceiling of the liquid flow path.

16 Claims, 8 Drawing Sheets

LIQUID DISCHARGE HEAD HAVING NARROWED PORTION OF LIQUID FLOW PATH BETWEEN LIQUID CHAMBER AND MOVABLE MEMBER, METHOD OF MANUFACTURE THEREFOR, AND LIQUID DISCHARGE APPARATUS HAVING SUCH HEAD

BACKGROUND OF THE INVENTION

1. Field of the Invention

The present invention relates to a liquid discharge head for performing such operation as to record or print characters, symbols, images, or the like, among some others, on a recording medium that includes paper, plastic sheet, cloths, commodity, or the like by discharging a functionating liquid, such as ink, to enable it to adhere thereto. for example. The invention also relates to a method of manufacture therefor, and a liquid discharge apparatus.

2. Related Background Art

As a liquid discharge head (ink jet recording head), there is the one that records images by bubbling ink to be discharged by utilization of thermal energy generated by heat generating members, for example.

Conventionally, as an ink jet recording head such as this, there is the ink jet recording head as shown in FIG. 9, for example, which is structured by mounting a ceiling plate 102, which is provided with an ink inlet port 103, a common liquid chamber 104, liquid flow paths 105, and discharge ports 107, on a base plate 101 having heat generating members 108 for bubbling use installed thereon for discharging ink.

For an ink jet recording head of the kind, various recording performances, such as image quality, resolution, and speed, among some others, are demanded to be higher still from now on. To materialize such higher recording performances, there is a need for structuring an ink jet recording head capable of discharging small ink liquid droplets with many numbers of discharge ports 107.

For the ink jet recording head of the kind, a method is adopted to simply make the area of a bubbling heat generating member smaller as the method to make a discharging ink droplet small in order to enhance the resolution. However, if the area of the heat generating member is made smaller, a desired bubbling cannot be obtained, because among the thermal energy generated by the heat generating member, the ratio of energy that may contribute to bubbling is caused to be gradually reduced. In order to generate a sufficient bubbling energy, it is necessary to set the area of heat generating member at a slightly larger value. If the area of the heat generating member is made larger, the dissipation of energy is increased inevitably. Also, if the area of the heat generating member is made smaller, a bubble itself becomes smaller to result in the reduced efficiency of bubble that should contribute to discharging. Also, if the arrangement density of nozzles is made higher in order to make a higher recording possible, the number of heat generating members should increase, while there is the incapability that the area of the heat generating member is made very small as described earlier. A problem is then encountered that the energy dissipation becomes greater.

In contrast, as the ink jet recording head capable of enhancing the energy efficiency by conducting the pressure exerted by bubbling to each discharge port efficiently, an ink jet recording head is disclosed in the specification of European Laid-Open Patent 0436047, which is provided with various kinds of valve mechanisms between the common liquid chamber and the heat generating member in the liquid flow path in order to cut off the liquid flow path when pressure is exerted by driving the heat generating member, and to permit the liquid flow at the time of refilling that necessitates the generation of ink flow from the common liquid chamber to each heat generating member after liquid has been discharged. This ink jet recording head is structured for the purpose of enhancing the energy efficiency by suppressing the escape of the pressure exerted by driving the heat generating member to the common liquid chamber side which is opposite to the discharge port, and conduct the pressure thus exerted to the discharge port side efficiently.

Also, as the ink jet recording head that discharges ink liquid droplets by enabling the pressure exerted by piezoelement to act on ink by utilization of the piezoelement which serves as an electromechanical converting member, there has been disclosed in the specification of U.S. Pat. No. 4,514,742, the ink jet recording head which is provided with various kinds of valve mechanisms between the ink replenishing path, through which ink is replenished to a pressure chamber, and the pressure chamber, which is provided with piezoelement for exerting pressure whereby to discharge ink, in order to cut off the liquid flow path when pressure is exerted by driving the piezoelement, and to permit the liquid flow at the time of refilling that necessitates the generation of ink flow from the ink supply path to the pressure chamber.

SUMMARY OF THE INVENTION

However, the valve mechanisms disclosed in the specification of European Laid-Open Patent 0436047 use a valve member the height of which is the same as that of the liquid flow path as the valve member that closes the liquid flow path, which moves in the condition where the valve member is in contact with the upper and lower faces of the flow path. As a result, when the valve member moves, friction occurs between the upper and lower faces of the flow path and the valve member to make it difficult to enable the valve member to move smoothly, hence making this arrangement impracticable.

Also, in the same specification, there is disclosed the structure in which a valve mechanism is arranged between the heat generating element and discharge port in addition to the one between the common liquid chamber and heat generating member. However, since this valve mechanism is structured so that the liquid flow path is closed in a steady state, the liquid flow is not allowed to occur unless a force is exerted to move the valve member. Therefore, although it is possible to refill liquid by moving the valve member by means of the difference between pressures exerted across the valve mechanism for the portion of the heat generating member where the pressure is reduced due to debubbling, there is a fear that liquid cannot be refilled sufficiently on the discharge port portion, because only the surface tension of liquid is the force usable for refilling liquid to the discharge port portion, which is not strong enough to serve the purpose.

Also, in the specification of U.S. Pat. No. 4,514,742 referred to earlier, the disclosed structure is such that the valve mechanism is formed by a valve seat configured as if to make a part of the liquid flow path narrower, and an elastically formed plate type valve member that cuts off the liquid flow path by being in close contact with the valve seat in a steady state where no ink flow occurs. This valve member is displaced by liquid flow when refilling so as to permit the liquid flow, but being biased to the valve seat side to cut off the liquid flow path in the steady state, the valve member needs a force to a certain extent to be deformed when refilling. As a result, there is a fear that the replenishing characteristic of liquid is deteriorated, because the valve is allowed to cut off the liquid flow path again before refilling has been carried out sufficiently.

Also, in the same specification, the disclose valve mechanism is such that the valve member is structured so as to form a hole on the center thereof to release the central part of the liquid flow path in the steady state. With this structure, however, the pressure exerted by driving the heat generating member is allowed to escape to the common liquid chamber side during the period until the deformed valve member is closely in contact with the valve seat, thus inevitably making the effect smaller in enhancing the energy efficiency.

Further, in the same specification, the disclosed structure is such that another passage is arranged to detour around the liquid flow path provided for the valve mechanism, but with the structure thus arranged, the pressure exerted by driving the heat generating member is partly allowed to escape through this passage, thus making the effect smaller in enhancing the energy efficiency. Also, the difference of pressures across the valve member that deforms the valve member is eased by way of this passage to make it impossible to effectuate the displacement of the valve member sufficiently. As a result, there is a fear that function of the valve mechanism is degraded eventually.

Now, therefore, it is an object of the present invention to provide an ink jet recording head provided with a novel valve mechanism whereby to solve the problems existing in the conventional examples discussed above by effectively utilizing the structural characteristics in the flow path so that not only the energy efficiency is enhanced, but the refilling of liquid can be executed smoothly.

From the different point of view, the present invention aims to provide an ink jet recording head having the movable member which is capable of efficiently regulating each bubble to be formed by film boiling with the substantial upper limit defined in the height component from the surface of a bubble to be generated (the surface of the heat generating member) depending on the height of the flow path for the bubble which is formed by film boiling generated in liquid by means of electrothermal converting device (heat generating member).

In order to solve the problems discussed above, the liquid discharge head of the present invention comprises discharge ports for discharging liquid as droplets; liquid flow paths communicated with the discharge ports, being provided with heat generating members for generating bubbles by providing thermal energy for liquid; and a common liquid chamber for retaining liquid to be supplied to the liquid flow paths. For the liquid discharge head thus structured, a narrower portion is provided between the liquid flow path and the heat generating member, and between the narrower portion and the heat generating member, a displaceable plate type movable member is provided in the liquid flow path thereof, and this movable member is formed to stand up from the surface of the liquid flow path having the heat generating member in the direction substantially perpendicular to the liquid supplying direction, having a designated gap in the narrower portion in the liquid supplying direction, and a fine gap in the plane of the free end thereof facing the surface of the liquid flow path having the heat generating member.

With the structure thus arranged, when a pressure is exerted by the bubble generated by the heat generating member, the movable member is displaced to the narrower portion side by the pressure thus exerted to close the liquid flow path substantially. Thus, the movement of liquid is prevented from shifting to the common liquid chamber side (upstream side) which is the side opposite to the discharge port of the liquid flow path. In this manner, the diffusion of the pressure exerted by bubbling to the upstream side is suppressed so as to conduct the exerted pressure to the discharge port side (downstream side) efficiently. Particularly, in the initial stage of bubbling, the bubble tends to be stretched horizontally in the vicinity of the plane (lower face) where the heat generating member is provided. However, with the movable member which is formed to stand up from the lower face, it becomes possible to effectively close around the lower face by means of the movable member, thus reducing the diffusion of the pressure waves in the upstream direction significantly when generated by the bubble in the initial stage of bubbling.

Also, when the bubble is grown, liquid cannot move in the plane (ceiling) direction that faces the surface where the movable member and the liquid flow path are formed. As a result, the bubble tends to be stretched mainly in the horizontal direction, and can hardly reach the ceiling. Then, in the vicinity of the ceiling, a fine layer (approximately 10 $\mu$m) is formed where almost no liquid flows. Further, since the pressure is propagated from the bubble to the liquid mainly on the normal line direction of the surface of the bubble, there is almost no flow of liquid in the liquid flow direction on this layer. Then, it is made easier for the liquid to flow gradually from this layer to the central portion of the flow path. For the present invention, it is desirable to set the height of the movable member that forms the fine gap in the ceiling at the height where the area of liquid flowing largely in the liquid flow path direction, that is, at the lower limit of the height of bubble when the bubble is grown to the maximum in the process of discharging liquid. Then, it is desirable to define the upper limit of the height of movable member so that this fine gap can secure the sufficient height to enable the aforesaid layer to be located therein with almost no liquid flow on the layer. With the fine gap thus set between the movable member and the ceiling, it becomes possible for the movable member to substantially close the area in the height direction, in which a large flow of liquid may occur in the liquid flow path direction if the movable member is not present. As a result, there is almost no diffusion of liquid to the upstream side through the fine gap during the growing process of the bubble. (There may be present, however, the liquid flow that passes the side direction of the movable member.)

On the other hand, by the exertion of the force after liquid is discharge, which causes liquid to flow to the heat generating member side due to the lowered pressure resulting from debubbling, the movable member is warped and deformed to the heat generating member side, and the gap between the movable member and the ceiling becomes larger. The free end of the movable member comes to the lower position, thus releasing partially the area where a large liquid flow may take place in the liquid flow direction to make it possible to induce liquid efficiently from the common liquid chamber into the liquid flow path.

In this way, the ink jet recording head of the present invention can suppress the diffusion of liquid to the upstream side when the heat generating member exerts pressure by bubbling, and induce liquid into the liquid flow path efficiently after liquid is discharged. Therefore, in the entire processes of liquid discharge, liquid can move from the common liquid chamber side to the discharge port side effectively, thus enabling the time to be shortened, which is required for filling liquid in the liquid flow path after ink has been discharged.

As described earlier, the area where almost no liquid flow occurs in the liquid flow path direction is an area within a distance of approximately 10 μm from the ceiling. It is desirable to set the fine gap between the movable member and the ceiling at 2 μm or more and 15 μm or less in condition that the movable member is not allowed to be deformed. Also, it is desirable to set the distance at 10 μm or less between the movable member and the narrower portion in the liquid flow path direction in order not to allow the fine gap to becomes excessive when the movable member is displaced to the narrower portion side.

Also, if the heat generating member is driven for a long time, the conventional head accumulates heat to cause the inner temperature of the ink jet recording head to rise high. In this case, the bubble grows larger with the same driving energy given to the head as compared with the case where the temperature is low. As a result, the amount of liquid discharges is caused to change eventually. For the ink jet recording head of the present invention, efficiency is improved as described above so that the area of the heat generating member is made smaller in order to provide the same amount of liquid discharge at the same discharge speed as the conventional one. In other words, it becomes possible to make the driving energy smaller than the one needed for the conventional ink recording head, hence suppressing and keeping the increase of the amount of liquid discharge to be small.

For the ink jet recording head of the present invention, it is desirable to set a distance at 30 μm or less between the movable member and the end portion of the heat generating member on the movable member side and the movable member, because otherwise the effect to suppress the diffusion of pressure to the upstream side becomes unsatisfactory due to the loss of the spacial energy when the bubble grows, and also, because the effect to deform the movable member to the heat generating member side becomes unsatisfactory when the bubble enters the process of debubbling.

As the material of the movable member, it is possible to use either silicon nitride, silicon oxide, or silicon carbide.

Also, from the different point of view, the features of the liquid discharge head of the present invention are such that the aforesaid movable member is made displaceable without being in contact with the plane of the liquid flow path that faces the surface where the heat generating member is provided, and the height of the movable member in the substantially perpendicular direction is higher than that of the bubble in the substantially perpendicular direction during the period from the generation of film boiling in liquid by the heat generating member to the maximum growth of the bubble formed by this film boiling. With the movable member thus provided, this member acts as the fluid resistive element to the pressure waves and liquid flow that runs, along with the growth of the bubble, to the backside region (refilling side) which is opposite to the discharge port, while the movable member is deformed or displaced at the time of refilling, thus making it possible to enhance the refilling effect.

In manufacturing the liquid discharge head of the present invention, the side walls of the liquid flow path and the movable member can be simultaneously formed by means of the semiconductor manufacturing process. This simultaneous formation of the liquid flow path walls and movable member promotes the efficiency of manufacturing. Also, in such semiconductor manufacturing process, structures of different configurations can be formed with ease on one and the same manufacturing line simply by changing mask patterns for etching or the like, thus making it easier to manufacture an ink jet recording head having the liquid flow path walls and movable member in different configurations. Here, also, the liquid flow path walls are formed by means of the semiconductor manufacturing process which is used for forming the heat generating members and driving circuit on a base plate, hence making the manufacture of a liquid discharge head possible with these members having high dimensional precision.

Also, the liquid discharge apparatus of the present invention is provided with the aforesaid liquid discharge head mounted thereon to enable droplets to adhere to a recording medium. This apparatus comprises a mechanism for carrying a recording medium.

In this respect, the description in the specification hereof to the effect that the "movable member stands up in the direction substantially perpendicular to the liquid supplying direction" means that the inclination of the movable member in the direction in which it stands up is within a range of approximately 10° in the direction perpendicular to the liquid supply direction.

Also, in the specification hereof, the "surface where the heat generating member is provided" is meant to include the face becoming the base of a heat generating member, the surface of the heat generating member, the surface of the protection layer to protect the heat generating member, and the like, which exist on the upper layer and lower layer of the plane where the heat generating member is provided, and the value of layer thickness of which is essentially negligible in comparison with the value of the height of the movable member.

BRIEF DESCRIPTION OF THE DRAWINGS

FIG. 5A shows the maximum bubbling state, and FIG. 5B shows the debubbled state.

DETAILED DESCRIPTION OF THE PREFERRED EMBODIMENTS

Hereinafter, in conjunction with the accompanying drawings, the embodiments of the present invention will be described.

Figure 1:
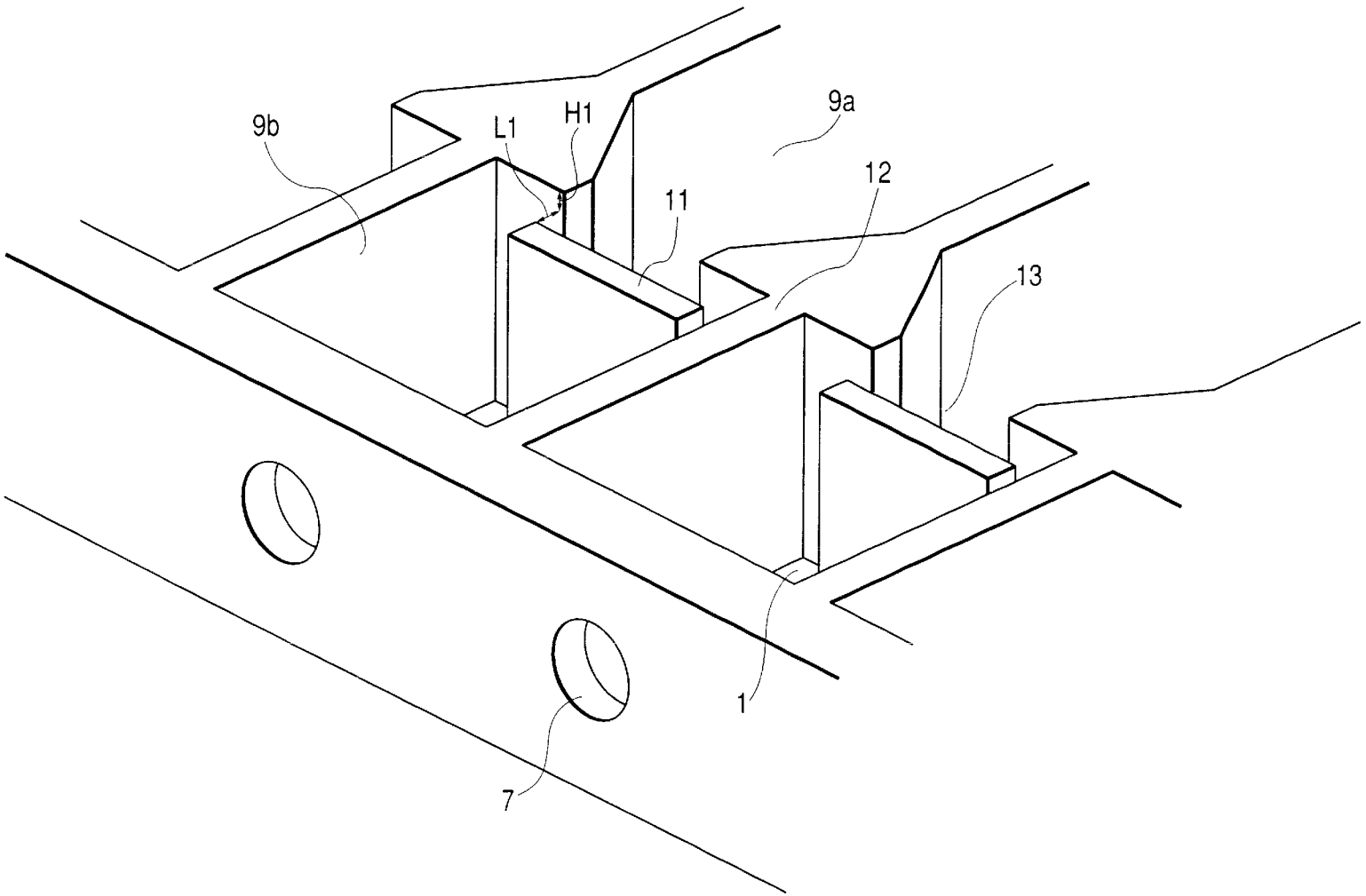
FIG. 1 is a perspective view which shows the liquid flow path portion of an ink jet recording head in accordance with one embodiment of the present invention.
Figure 2:
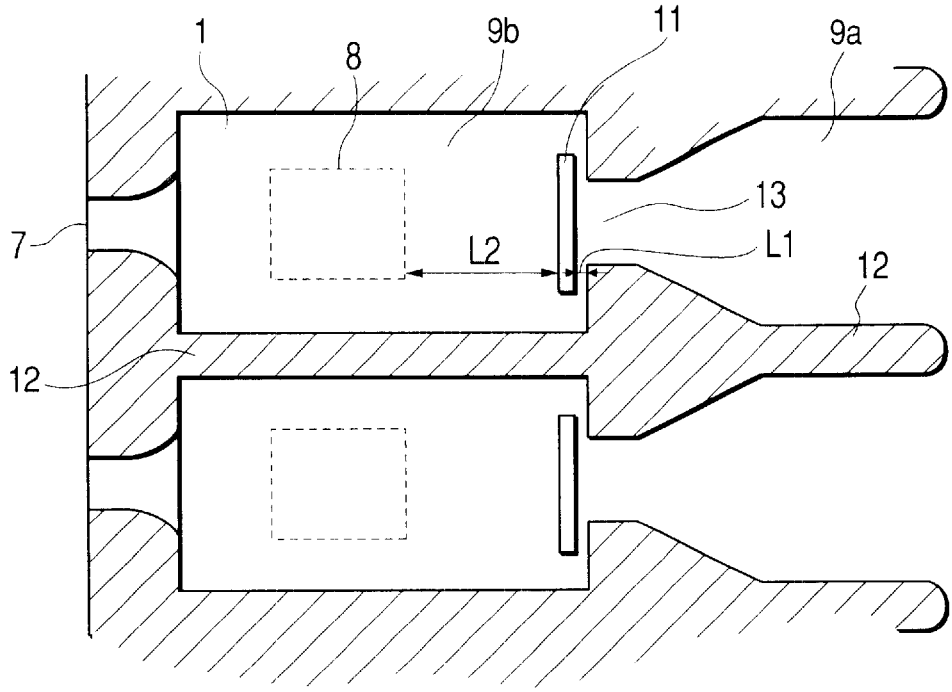
FIG. 2 is a plan view which shows the liquid flow path portion of the ink jet recording head represented in FIG. 1.
Figure 3:
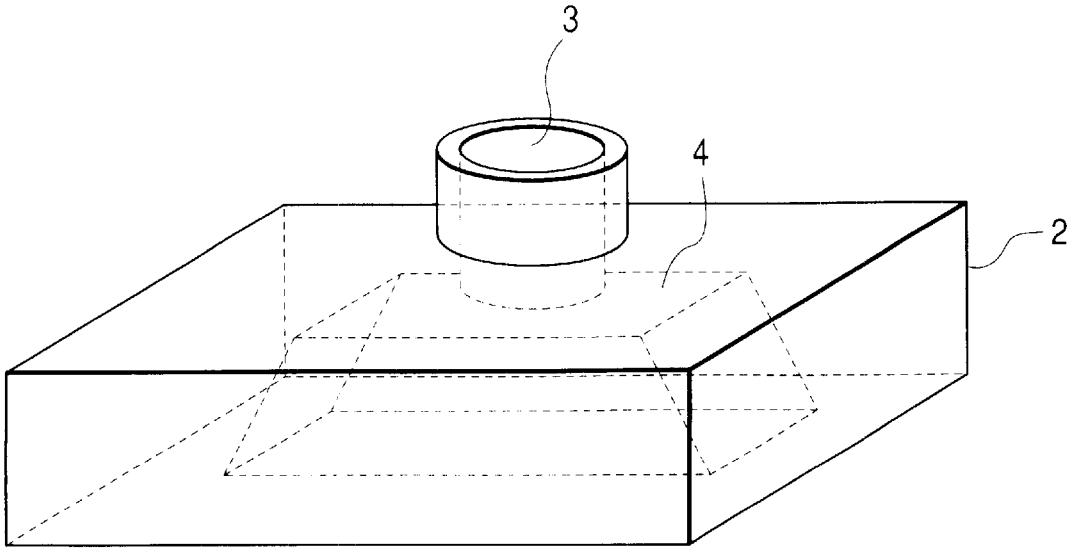
FIG. 3 is a perspective view which shows the ceiling plate of the ink jet recording head represented in FIG. 1.

FIG. 1 to FIG. 3 are views which illustrate an ink jet recording head in accordance with one embodiment of the present invention. FIG. 1 is a perspective view which shows the portion 9 of a liquid flow path of the ink jet recording head. FIG. 2 is a plan view thereof. FIG. 3 is a view which shows the ceiling plate arranged on the upper face of the liquid flow path 9.

As shown in FIG. 2, each of the heat generating members 8 for bubbling use is formed on the base plate 1 in line at designated intervals. On the base plate 1, each of the liquid flow paths 9 is formed by each of the liquid flow path walls 12 which is formed at the intervals corresponding to each of the heat generating members 8. On each portion forming the edge of the liquid flow path 9 of the liquid flow path wall 12, a discharge port 7 is formed for discharging liquid (ink). On the way of the liquid flow path 9, a movable member 11 is formed on the upstream side of the heat generating member 8 (the side opposite to the discharge port 7) so as to close a part of the liquid flow path 9 for separating the liquid flow path 9 into a liquid flow path 9*a* on the upstream side, and a liquid flow path 9*b* on the downstream side. The movable member 11 is formed so as to stand up substantially in the vertical direction to the base plate 1 in a state of no force being added thereto. With the fixed bottom as the fulcrum thereof, the movable member is displaceable in the flow direction of ink (that is, elastically deformable). On the upstream side of the movable member 11, a narrower portion 13 is formed to make the width of the liquid flow path 9 smaller so as to block the displacement of the movable member 11 to the upstream side. Between the narrower portion 13 and the movable member 11, a gap L1 is provided, and the height of the movable member 11 is made lower than that of the liquid flow path wall 12 by an amount H1. On the upper face of the liquid flow path wall 12, there is bonded the ceiling plate 2 which is provided with a common liquid chamber 4 communicated with each of the liquid flow paths 9, and the ink inlet port 3 through which ink is induced from outside the ink jet recording head into the common liquid chamber 4, thus structuring an ink jet recording head. For this structure, there is no need for matching the position of the ceiling plate 2 with that of the liquid flow path 9 exactly, hence making it easier to position them for carrying out manufacture extremely easily. Also, with the movable member 11 the height of which is made lower than that of the liquid flow path wall 12 by the amount H1, it is made possible to move the movable member smoothly without contacting the ceiling plate 2.

Next, with reference to FIGS. 4A to 4G, 5A, and 5B, the description will be made of the state of discharging ink by heating ink to be bubbled by use of the heat generating member 8. FIGS. 4A to 4G are views each showing liquid discharge process in sequence. FIGS. 5A and 5B are enlarged views each showing the vicinity of the movable member 11; FIG. 5A indicates the maximum bubbling state, and FIG. 5B, the debubbled state.

Figure 4A:
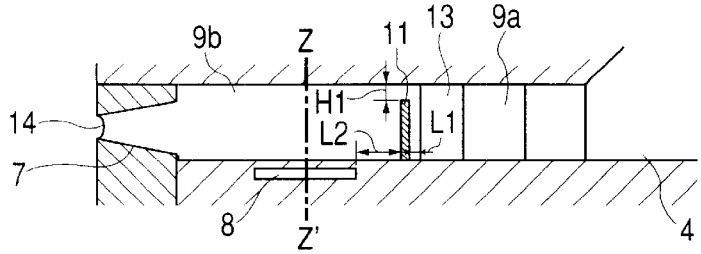
FIGS. 4A, 4B, 4C, 4D, 4E, 4F and 4G are views which schematically illustrate the liquid discharge processes of the ink jet recording head represented in FIG. 1.
Figure 5B:
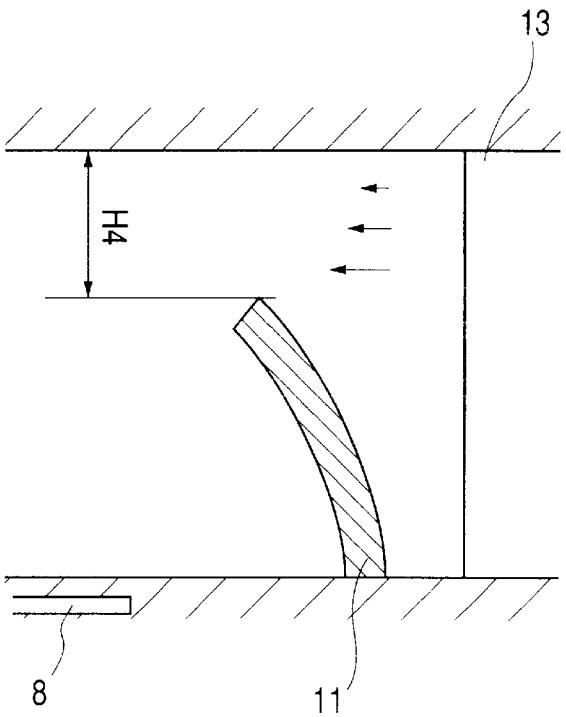
FIGS. 5A and 5B are cross-sectional views which illustrate the vicinity of the movable member of the ink jet recording head represented in FIG. 1.
Figure 5A:
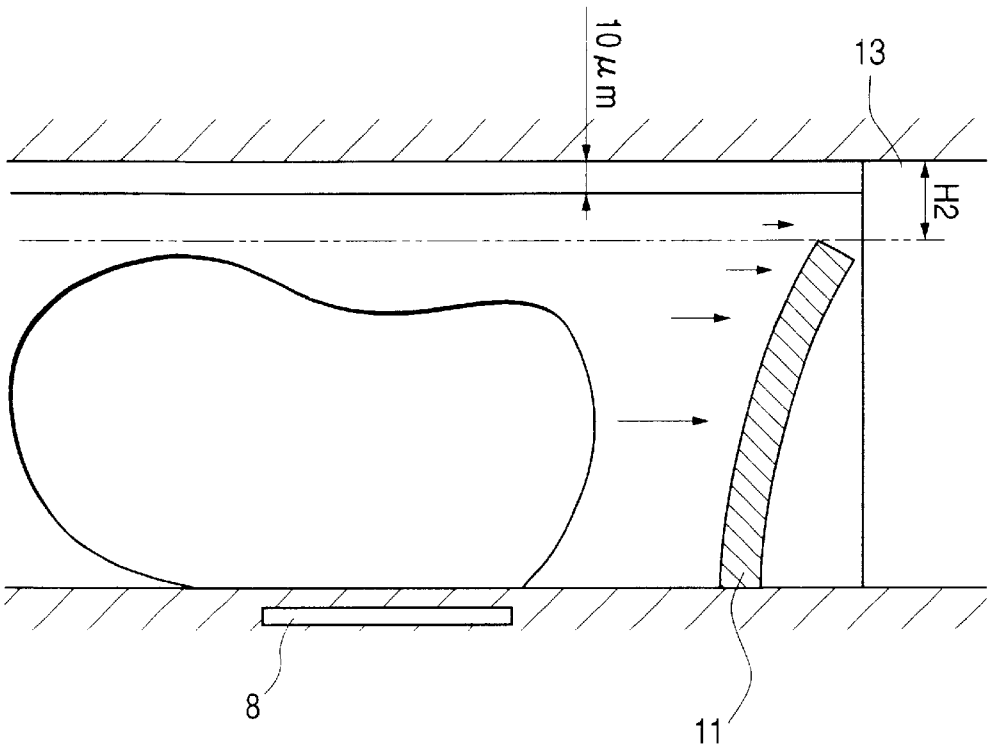

FIG. 4A shows the state before the heat generating member 8 is driven, with ink being filled in the liquid flow path 9. In this state, the meniscus 14 where ink and the air are in contact is stabilized in the portion of discharge port 7, and the movable member 11 is also stabilized without receiving any force.

Figure 4B:
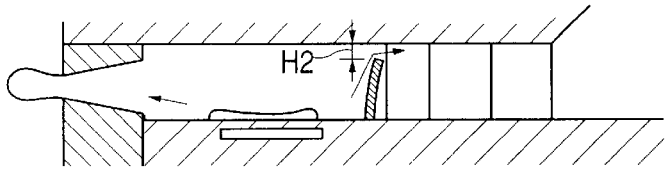

When the heat generating member 8 is energized by a driving circuit (not shown), the heat generating member 8 is heated, and the temperature rises. When the interfacial temperature of the upper part of the heat generating member 8 with ink reaches the film boiling temperature of ink, the film boiling occurs in ink. Then, as shown in FIG. 4B, bubbling begins. The bubble thus generated by bubbling tends to be stretched radially from the upper part of the heat generating member 8. However, with the ceiling existing above, ink can hardly move in this direction. Ink, therefore, tends to be grown largely in the horizontal direction. Here, if no movable member 11 is installed, the flow path resistance in the liquid flow path 9*b* on the downstream direction from the heat generating member 8 to the discharge port 7 becomes relatively large in comparison with the flow path resistance in the liquid flow path 9*a* on the upstream direction from the heat generating member 8 to the common liquid chamber 4, because there exists the discharge port 7. As a result, the bubble should be grown largely as if crawls on the lower face of the liquid flow path 9*a* in the upstream direction, and the pressure inevitably escapes in the upstream direction. In contrast, the ink jet recording head of the present embodiment provides the movable member 11 to close the liquid flow path 9*a,* the lower side thereof in particular, it becomes possible to effectively suppress the growth of the bubble to the upstream side, thus conducting the pressure to the discharge port 7 side. Particularly, the bubble tends to be stretched horizontally near the lower face in the initial stage of bubbling. Then, the diffusion of the pressure waves in the upstream direction at this juncture can be reduced significantly.

As described above, with the provision of the movable member 11, it becomes possible to obtain the action which enables the discharge amount of ink to be discharged and the discharge speed to be increased. Consequently, the energy to be generated by the heat generating member 8 can be smaller to obtain the same discharge amount and discharge speed for the ink jet recording head of the present embodiment which is provided with the movable member 11 than for the one which is not provided with the movable member 11. Therefore, even with the smaller area of the heat generating member 8 or the smaller driving energy given to the heat generating member 8, the same discharge amount and discharge speed can be obtained, that is, it becomes possible to make the energy dissipation smaller for an ink jet recording head.

In this respect, if the distance L2 between the heat generating member 8 and the movable member 11 is longer in the flow path direction, the spacial energy loss is caused to incur so as to reduce the suppressing effect of the bubble growth to the upstream side eventually. Therefore, it is desirable to set the distance L2 at 30 $\mu$m or less between the end portion of the heat generating member 8 on the upstream side and the movable member 11.

Figure 4C:
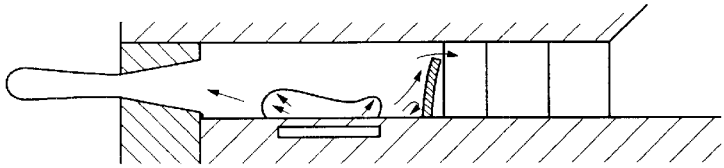
Figure 4D:
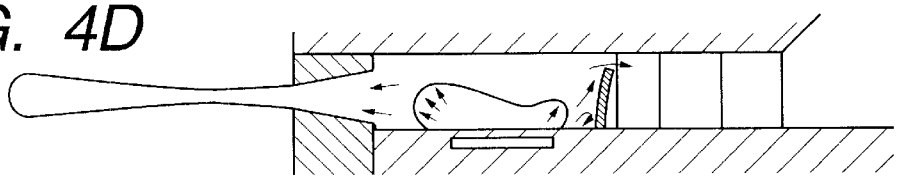

Here, as shown in FIGS. 4B, 4C and 4D, when the bubble grows, the movable member 11 is displaced by the pressure added in the direction toward the upstream side. Then, the gap between the movable member 11 and the ceiling becomes larger from the H1 to the H2. However, the displacement of the movable member 11 is restricted by the presence of the narrower portion 13, and the resultant change from the H1 to H2 cannot be very large. Also, in the vicinity of the ceiling, there is formed usually a fine layer (approximately 10 $\mu$m) where almost no ink flow occurs. Further, ink moves by means of the pressure exerted in the normal line direction of the surface of the bubble. Also, as described earlier, the bubble is not allowed to grow largely in the ceiling direction. Therefore, as shown in FIG. 5A, almost no ink flows on this layer even when the bubble is grown to the maximum. Then, liquid is made easier to flow gradually from this layer toward the central portion of the flow path. Now, in accordance with the present embodiment, it is arranged to set the size of the movable member 11 and the fine gap so as to essentially close by use of the movable member 11 the height direction of the area where a large flow of ink may take place if there is no movable member 11, that is, the area existing below the height of the bubble grown to the maximum as shown in FIG. 5A. In this manner, almost no ink is allowed to be diffused from this fine gap to the upstream side. As a result, the loss is small due to the escape of ink to the upstream side from the fine gap between the movable member 11 and the ceiling.

Such as this, it is desirable to set the distance H2 between the movable member 11 and the ceiling at 2 to 10 $\mu$m approximately in order to prevent ink from escaping to the upstream side from the fine gap between the movable member 11 and the ceiling. Also, in order not to make the distance H2 too large between the movable member 11 and the ceiling when the movable member 11 is displaced to the upstream side, it is desirable to set the distance L1 at approximately 10 $\mu$m or less between the narrower portion 13 and the movable member 11 in the flow path direction.

Figure 4E:
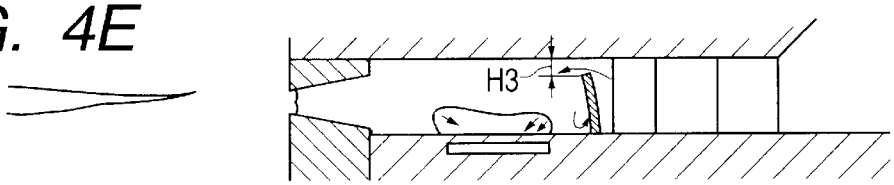
Figure 4F:
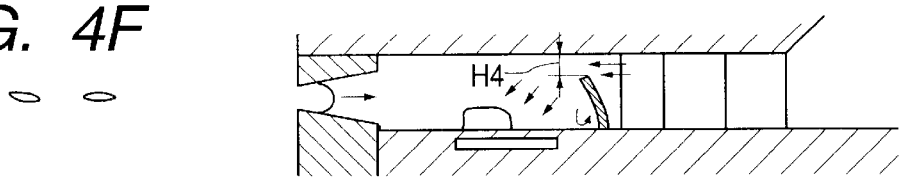
Figure 4G:
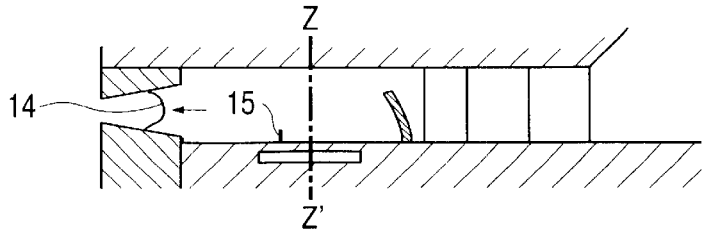

At the time of bubble extinction, the movable member 11 is pulled to be curved to the downstream side as shown in FIGS. 4E, 4F and 4G. Then, the distance between the movable member 11 and ceiling becomes larger to H3 and H4 to make the flow path area larger. Thus, the flow resistance becomes smaller on the upstream side. Further, as shown in FIG. 5B, the free end of the movable member 11 comes to the lower position, and partially releases the area where a large flow of ink may take place, hence making it possible to conduct ink efficiently for refilling from the liquid flow path 9*a* on the upstream side.

As described above, the ink jet recording head of the present embodiment can reduce the amount of ink that flows to the upstream side, and conduct ink efficiently to the downstream side at the time of bubble growth. Then, at the time of bubble extinction, ink can be conducted efficiently to the downstream side by the displacement of the movable member 11. Therefore, from the viewpoint of the entire ink discharge processes, ink is made movable to the downstream side. Thus, as shown in FIG. 4G, the debubbled portion 15 of the bubble is positioned on the downstream side of the center line Z–Z' of the heat generating member 8, and also, after ink discharge, the amount of meniscus becomes smaller when retracted to the backside of the discharge port 7.

As described above, in accordance with the present embodiment, the ink jet recording head is provided with the movable member 11 to efficiently contact the movement of ink by bubbling to the discharge port 7 side for discharging ink with a smaller amount of energy dissipation at lower driving costs. For the ink jet recording head that performs a high quality recording in high resolution with many numbers of ink discharge ports 7 in particular, the area of each heat generating member 8 can be made smaller to reduce the energy dissipation significantly. Further, the amount of meniscus 14 can be made smaller when retracted from the discharge port 7 after ink discharge, thus making it possible to shorten the time required for the meniscus to be in the state of being returned near the discharge port 7 (as indicated in FIG. 4A). As a result, ink can be discharged repeatedly faster to make a higher speed recording possible where the discharge of liquid droplets should be repeated at a higher frequency.

Also, in the processes of bubble growth and extinction, pressure is exerted on the foot portion of the movable member 11, but as shown in FIGS. 4A to 4G, ink is caused to flow in a whirl because the ink flow that advances straightly in the vicinity of the foot of the movable member 11 is blocked. Consequently, the pressure exerted on the foot portion of the movable member 11 is not caused to become very large, thus making the influence that may be given to the durability of the movable member 11 smaller. Also, the displacement amount of the movable member is not made too large, and the stress exerted on the foot portion which becomes the fulcrum of displacement is small accordingly. Therefore, the durability of the movable member 11 is high for the ink jet recording head of the present embodiment.

Next, with reference to FIGS. 6A to 6H, the description will be made of a method for manufacturing the movable member 11 of an ink jet recording head shown in FIG. 1 to FIG. 3.

Figure 6A:
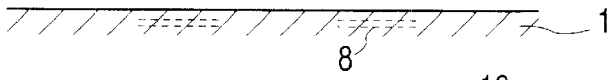
FIGS. 6A, 6B, 6C, 6D. 6E, 6F, 6G and 6H are views which schematically illustrate the manufacturing processes of the ink jet recording head represented in FIG. 1.
Figure 6B:
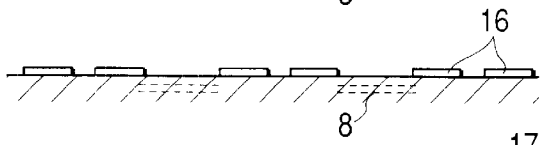
Figure 6C:
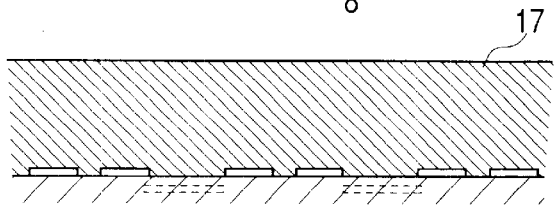
Figure 6D:
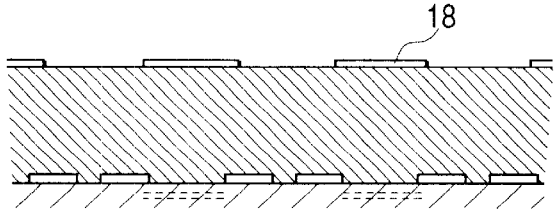
Figure 6E:
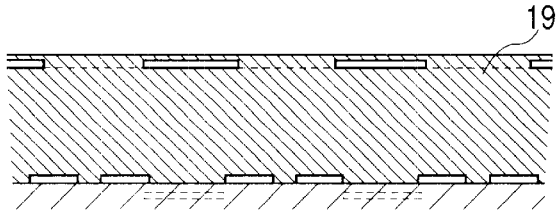
Figure 6F:
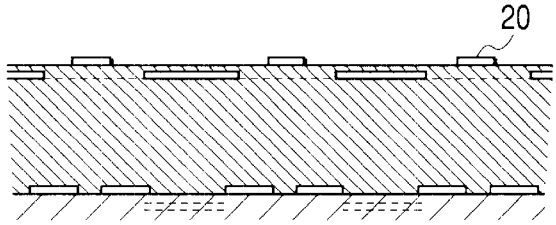
Figure 6G:
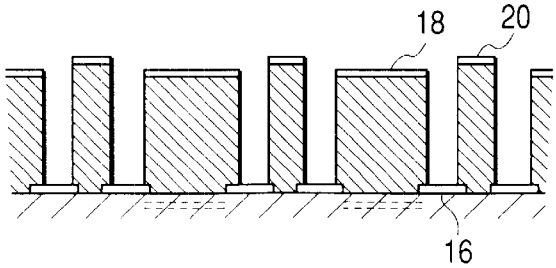
Figure 6H:
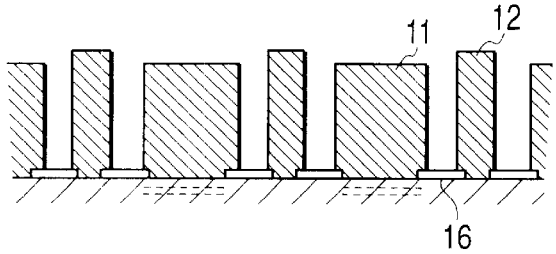

FIG. 6A is the upper sectional view which shows the base plate 1 having the heat generating member 8 installed thereon for bubbling use. On this base plate 1, an aluminum layer is formed by sputtering, and then, etched to form the first etching stop layer 16 as shown in FIG. 6B, which protects the base plate 1 from being damaged when a silicon nitride film (a first SiN film) 17 is etched in the next step. Then, on this layer, the first SiN film 17 is formed at a high speed by means of plasma CVD (Chemical Vapor Deposition) or the like as shown in FIG. 6C. The first SiN film 17 becomes the material for the movable member 11 and the liquid flow path wall 12. After that, on this film, an aluminum layer is formed by sputtering, and then, etched to form a second etching stop layer 18, as shown in FIG. 6D, in order to provide a fine gap between the movable member 11 and the ceiling plate 2, thus making the movable member 11 displaceable. Then, on this layer, a silicon nitride film (a second SiN film) 19 is formed again as shown in FIG. 5E. On this film, then, an aluminum layer is formed by sputtering and etched to form an etching mask layer 20 as shown in FIG. 6F for use of etching the first and second SiN films 17 and 19. Then, as shown in FIG. 6G, the first and second SiN layers 17 and 19 are etched at a high speed up to the portions of the first and second etching stop layers 16 and 18. Lastly, the first and second etching stop layers 16 and 18 and aluminum of the etching mask layer 20 are removed to form the movable member 11 and the liquid flow path walls 12 as shown in FIG. 6H. The height of the liquid flow path wall 12 becomes the thickness in which the first and second SiN films 17 and 19 are formed. When setting this height, therefore, the discharge amount, the discharge speed, the bubbling time for the minimum repetition, and others should be taken into consideration to provide desired values for them, respectively.

As described above, the movable member 11 and the liquid flow path wall 12 can be processed at the same time by means of the general semiconductor process. With this semiconductor process, it is possible to manufacture them almost in the same process even if the patterns of the movable member 11, the liquid flow path wall 12, and the like are different. Therefore, with the one and same manufacturing line, an optimal ink jet recording head can be manufactured with ease in accordance with the specification of an ink jet recording apparatus (printer) on which an ink jet recording head is mounted.

Also, the driving circuit, the heat generating member 8 for bubbling use, and the liquid flow path wall 12 can be manufactured on one silicon wafer by means of the semiconductor process to make it possible to enhance the dimensional precision in the process significantly. Thus, an ink jet recording head can be manufactured with a highly stabilized ink discharge capability.

Figure 7A:
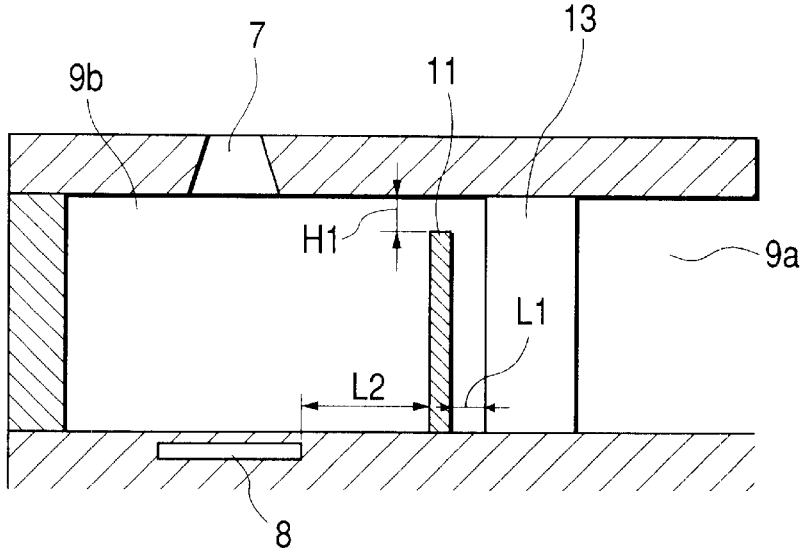
FIGS. 7A and 7B are cross-sectional views which illustrate the liquid flow path portion of an ink jet recording head in accordance with another embodiment of the present invention.
Figure 7B:
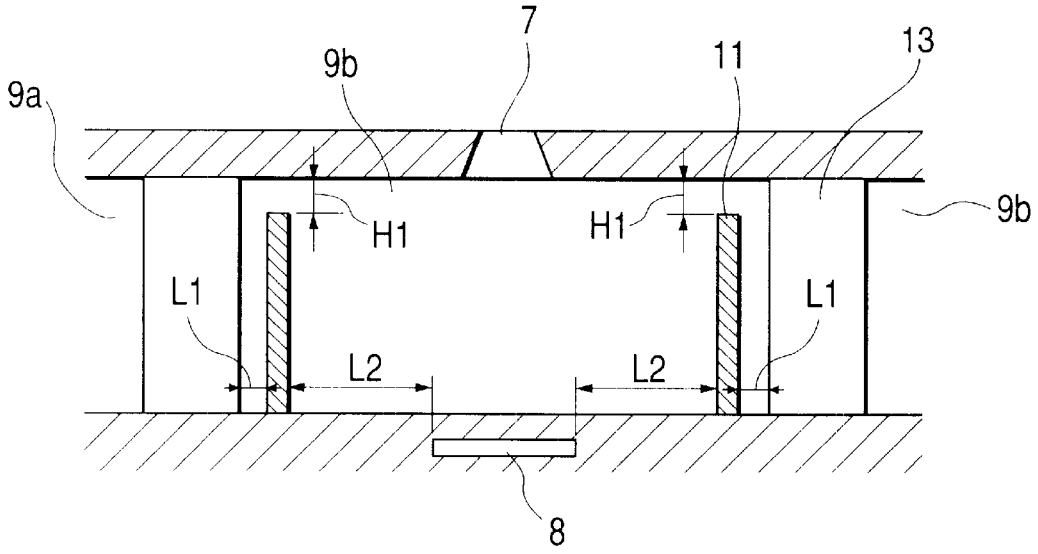

FIGS. 7A and 7B are cross-sectional views which illustrate a liquid discharge head in accordance with another embodiment of the present invention. In FIGS. 7A and 7B, the same reference marks are applied to the same parts appearing in the embodiment described in conjunction with FIG. 1 to FIG. 3, and the description thereof will be omitted.

The ink jet recording head shown in FIGS. 7A and 7B is different from the one shown in FIG. 1 to FIG. 3 in the ink discharging direction by 90 degrees. In other words, whereas the ink jet recording head shown in FIG. 1 to FIG. 3 discharges ink in the direction parallel to the surface where the heat generating member 8 is formed, the ink jet recording head shown in FIGS. 7A and 7B is provided with the discharge port 7 in the direction perpendicular to the plane where the heat generating member 8 is formed, and ink is discharged in that direction.

The ink jet recording head shown in FIG. 7A is arranged to induce ink in one direction (in the right direction in FIG. 7A) of the liquid flow path 9 for discharging, and the movable member 11 and the narrower portion 13 are provided on the right side of the heat generating member 8. The opposite side is arranged to be a wall. On the other hand, the ink jet recording head shown in FIG. 7B is arranged to induce ink in both directions of the liquid flow path 9, and the movable member 11 and the narrower portion 13 are provided respectively on both sides of the heat generating member 8.

As has been described, the discharge operations are essentially the same as those described in conjunction with FIGS. 4A to 4G, FIGS. 5A and 5B, although the ink jet recording heads present the different directions of ink discharges. With the provision of the movable member 11 as in the case of the ink jet recording head shown in FIG. 1 to FIG. 3, the energy dissipation becomes smaller to make it possible to repeat liquid droplet discharges at a high frequency.

In this respect, for either of the ink jet recording heads shown in FIG. 7A and FIG. 7B, it is desirable to set the distance H1 at approximately 2 to 15 $\mu$m between the ceiling and the movable member 11; the distance L1 at approximately 10 $\mu$m or less between the narrower portion 13 and the movable member 11; and the distance L2 at approximately 30 $\mu$m or less between the heat generating member 8 and the movable member 11 as in the case of the ink jet recording head shown in FIG. 1 to FIG. 3.

Figure 8:
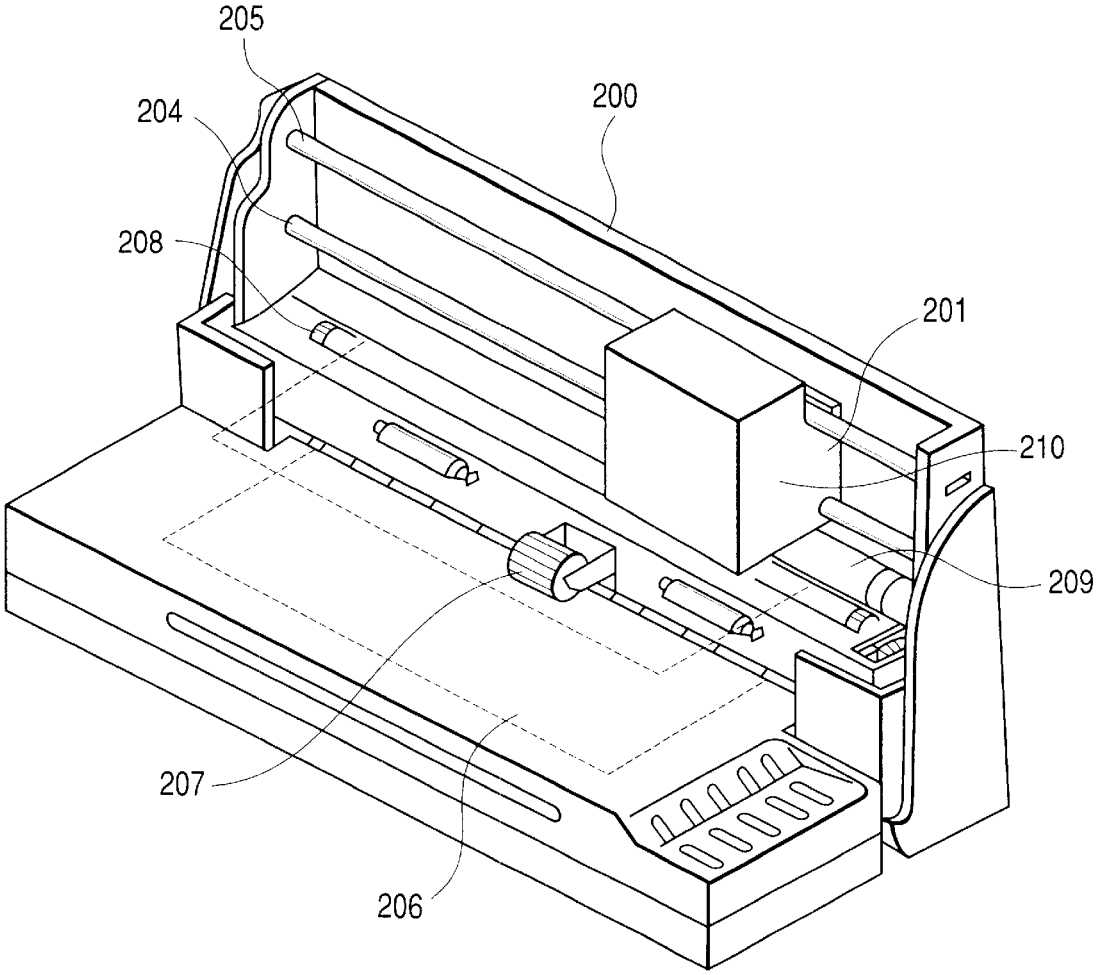
FIG. 8 is a perspective view which shows an ink jet recording apparatus in accordance with one embodiment of the present invention.
Figure 9:
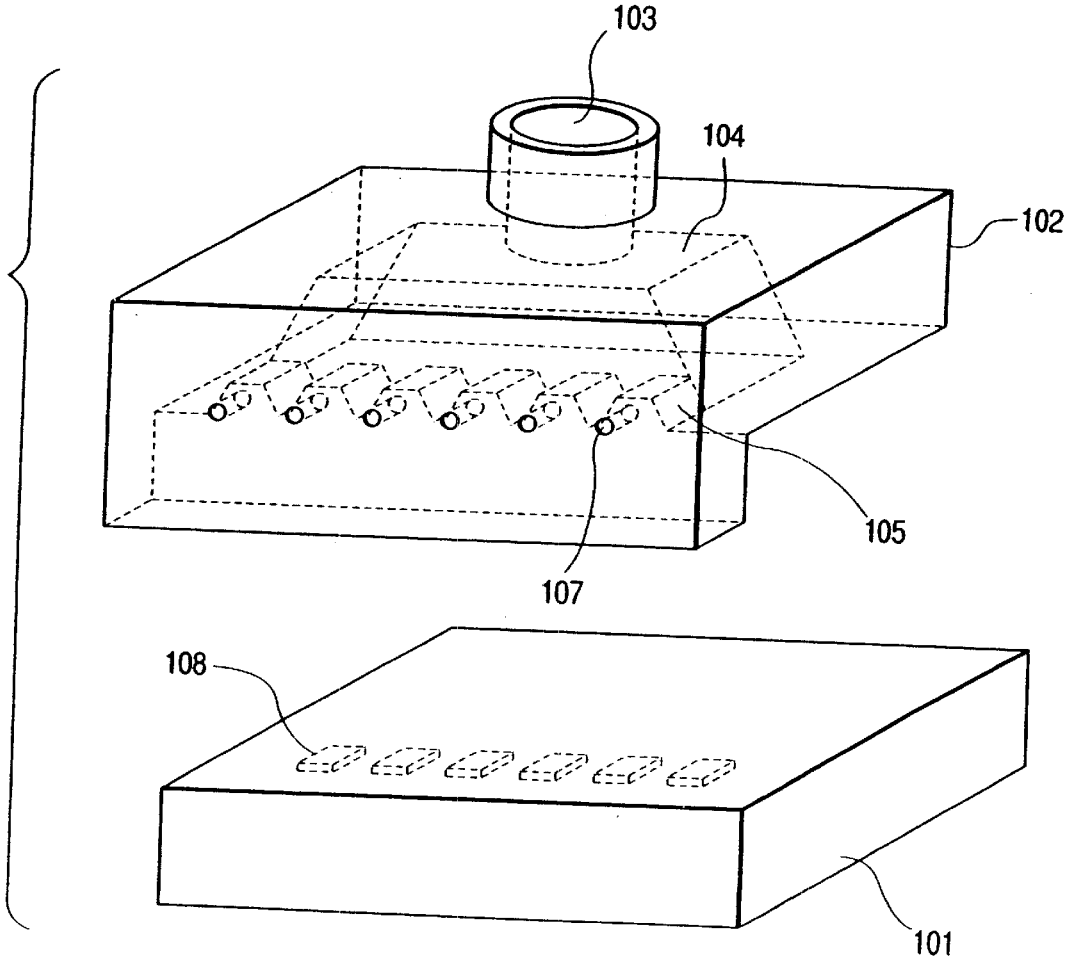
FIG. 9 PRIOR ART
FIG. 9 is a view which schematically shows the conventional example of an ink jet recording head.

FIG. 8 is a perspective view which shows an ink jet recording apparatus 200 having mounted thereon a head cartridge 210 provided with the aforesaid ink jet recording head. The ink jet recording apparatus shown in FIG. 8 is provided with the lead screw 204 and the guide shaft 205 arranged in parallel to each other in a housing. For the lead screw 204 and the guide shaft 205, a carriage 201 is installed movably in the direction parallel to the lead screw 204 and the guide shaft 205. The carriage 201 moves in parallel to the lead screw 204 as it rotates by use of a carriage motor (not shown).

On the carriage 201, is mounted the head cartridge 210 provided with the ink jet recording head as shown in FIG. 1. There is provided a paper pressure plate 209 in the vicinity of the locus plane of the movement of the discharge surface of the ink jet recording head.

Also, the ink jet recording apparatus comprises the sheet feeding roller 207 that carries a recording sheet 206 serving as a recording medium to the recording area of the ink jet recording head, and the sheet expelling roller 208 that expels the recording sheet 206 after recording by the ink jet recording head. The sheet feeding roller 207 and the sheet expelling roller 208 are rotated by use of a motor (not shown). The recording medium carrying mechanism, which carries the recording sheet 206 for receiving liquid discharged from the ink jet recording head of the head cartridge 210, is structured by the aforesaid motor, the sheet feeding roller 207, the sheet expelling roller 208, and others. Then, the carriage 201 reciprocates in the direction intersecting with the carrying direction of the recording sheet 206 using the recording medium carrying mechanism.

With the adhesion of ink discharged from the ink jet recording head to the recording sheet 206 that faces the discharge port surface of the ink jet recording head, recorded images are formed on the surface of the recording sheet 206. Interlocked with recording on the recording sheet 206 by means of the ink jet recording head, the recording sheet 206 is expelled outside the ink jet recording apparatus by use of the sheet feeding roller 207 and sheet expelling roller 207 driven by the motor to rotate, as well as by use of the sheet pressure plate 209.

What is claimed is:

1. A liquid discharge head comprising:

a discharge port for discharging liquid in the form of droplets;

a liquid flow path communicating with said discharge port, being provided with a heat generating member for generating a bubble by providing thermal energy to the liquid; and a common liquid chamber for retaining the liquid, which is to be supplied to said liquid flow path, wherein, in said liquid flow path, a narrowed portion is provided between said common liquid chamber and said heat generating member, and a displaceable plate type movable member is provided between said narrowed portion and said heat generating member, said movable member being formed to stand up from a surface of said liquid flow path having said heat generating member in a direction substantially perpendicular to a liquid supplying direction, a first gap being provided between said movable member and said narrowed portion in the liquid supplying direction, and a second gap being provided between a free end of said movable member and a ceiling of said liquid flow path.

2. A liquid discharge head according to claim 1, wherein said movable member is displaced to close said narrowed portion substantially in accordance with the generation of the bubble, and displaced toward said heat generating member so as to make said second gap larger in accordance with the contraction of the bubble.

3. A liquid discharge head according to claim 1, wherein a height of said movable member in the substantially perpendicular direction is greater than a height of the bubble in the substantially perpendicular direction during a period from the generation of film boiling in the liquid by said heat generating member to a maximum growth of the bubble formed by the film boiling.

4. A liquid discharge head according to claim 1, wherein said second gap is a gap in the substantially perpendicular direction and serves not to allow said movable member to be in contact with a layer in said liquid flow path in which essentially no liquid flows.

5. A liquid discharge head according to claim 1, wherein a height of said movable member in the substantially perpendicular direction is greater than a height of the bubble in the substantially perpendicular direction during a period from the generation of film boiling in the liquid by said heat generating member to a maximum growth of the bubble formed by the film boiling, while said second gap is a gap in the substantially perpendicular direction and serves not to allow said movable member to be in contact with a layer in said liquid flow path in which essentially no liquid flows.

6. A liquid discharge head according to claim 1, wherein said second gap is 2 $\mu$m or more and 15 $\mu$m or less in a state of said movable member being not displaced.

7. A liquid discharge head according to claim 1, wherein said first gap, which is provided between said movable member and said narrowed portion in the liquid supplying direction, is 10 $\mu$m or less.

8. A liquid discharge head according to claim 1, wherein a third gap, which is provided between said movable member and an end portion of said heat generating member closest to said movable member in the liquid supplying direction, is 30 $\mu$m or less.

9. A liquid discharge head according to claim 1, wherein a material of said movable member is formed of at least one of silicon nitride, silicon oxide, and silicon carbide.

10. A liquid discharge head according to claim 1, wherein side walls of said liquid flow path and said movable member are formed in one and the same manufacturing process.

11. A liquid discharge head according to claim 10, wherein the manufacturing process is a semiconductor manufacturing process.

12. A liquid discharge apparatus having a liquid discharge head according to claim 1 mounted thereon to enable the droplets to adhere to a recording medium, comprising:

a mechanism for carrying the recording medium.

13. A liquid discharge head comprising:

a discharge port for discharging liquid in the form of droplets;

a liquid flow path communicating with said discharge port, being provided with a heat generating member for generating a bubble by providing thermal energy to the liquid;

a common liquid chamber for retaining the liquid, which is to be supplied to said liquid flow path; and a displaceable plate type movable member provided between said common liquid chamber and said heat generating member in said liquid flow path to be formed to stand up from a surface of said liquid flow path having said heat generating member in a direction substantially perpendicular to a liquid supplying direction, a gap being provided between a free end of said movable member and a ceiling of said liquid flow path, wherein said movable member is displaced without contacting with a plane of said liquid flow path facing said surface having said heat generating member provided thereon, and a height of said movable member in the substantially perpendicular direction is greater than a height of the bubble in the substantially perpendicular direction during a period from the generation of film boiling in the liquid by said heat generating member to a maximum growth of the bubble formed by the film boiling.

14. A liquid discharge head according to claim 13, wherein side walls of said liquid flow path and said movable member are formed in one and the same manufacturing process.

15. A liquid discharge head according to claim 14, wherein the manufacturing process is a semiconductor manufacturing process.

16. A liquid discharge apparatus having a liquid discharge head according to claim 13 mounted thereon to enable the droplets to adhere to a recording medium, comprising:

a mechanism for carrying the recording medium.

* * * * *